US006347853B1

(12) United States Patent
Kato

(10) Patent No.: US 6,347,853 B1
(45) Date of Patent: Feb. 19, 2002

(54) INK JET RECORDER WITH A REMAINING INK VOLUME DETECTOR

(75) Inventor: Yasuo Kato, Okazaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/268,636

(22) Filed: Mar. 16, 1999

(30) Foreign Application Priority Data

Mar. 31, 1998 (JP) ..... 10-086678

(51) Int. Cl.[7] ..... B41J 2/195
(52) U.S. Cl. ..... 347/7
(58) Field of Search ..... 347/7, 85

(56) References Cited

U.S. PATENT DOCUMENTS 5,975,665 A * 11/1999 Torigoe et al. ..... 347/7
6,086,178 A * 7/2000 Kawashima et al. ..... 347/7
6,099,114 A * 8/2000 Sasaki ..... 347/86

FOREIGN PATENT DOCUMENTS

JP A-8-112910 5/1996

* cited by examiner

*Primary Examiner*—Craig A. Hallacher
(74) *Attorney, Agent, or Firm*—Oliff & Berridge, PLC

(57) ABSTRACT

An ink jet recorder comprises a carriage for holding an ink jet head, capable of sweeping across a recording medium, an ink cartridge for supplying ink to the head, and a detector for detecting whether the fluid level of the ink inside the ink cartridge is at a prescribed level. At least two detection operations are performed by the detector. If two of those detection operations indicate an ink fluid level short of the prescribed level, ink cartridge replacement is displayed on a display. Erroneous ink level judgments can thus be held to a minimum even when the ink forms waves inside the ink cartridge due to the movement of the carriage in the sweep direction.

28 Claims, 7 Drawing Sheets

INK JET RECORDER WITH A REMAINING INK VOLUME DETECTOR

BACKGROUND OF THE INVENTION

1. Field of the Invention

This invention relates to a remaining ink volume detector such as is used in ink jet recorders and the like, and particularly to an ink jet recorder that comprises a remaining ink volume detector that can definitely detect whether or not there is a remaining volume of ink in an ink cartridge.

2. Description of the Related Art

Ink jet recorders are known wherein ink supplied by an ink cartridge is ejected from a print head. In this type of ink jet recorder, a remaining ink volume detector is provided for detecting remaining ink volume in the ink cartridge. This remaining ink volume detector is usually configured with an optical sensor comprising a light emitting unit that focuses a light beam on the transparent or semitransparent case of the ink cartridge, and a photodetector that receives reflected light from the ink cartridge. The remaining ink volume detection by the optical sensor is performed, when the print head, on which is mounted the ink cartridge, has been moved by the carriage to a detection position opposite the optical sensor, at that detection position. The light beam from the light emitting unit of the optical sensor is directed against the side wall surface of the ink cartridge, and the presence or absence of a remaining ink volume is determined using the fact that the reflected light reflectance from the ink cartridge side wall surface changes depending on the presence or absence of ink.

Unfortunately, immediately after the carriage has moved to the detection position, waves are generated on the fluid surface of the ink in the ink cartridge due to vibration induced by carriage movement. Because the remaining ink volume is detected by the optical sensor under these conditions, the optical sensor recognizes ink adhering to the inner walls of the ink cartridge at positions either above or below the actual ink fluid surface, giving rise to the fear of producing erroneous detection results.

In Japanese Patent Application Laid-open No. 8-112910 is disclosed an optical remaining ink volume detector that detects remaining ink volumes by measuring, at multiple times, changes in optical reflectance at the interface between an ink cartridge and an ink absorber inside the ink cartridge. However, there is wide variation in the position where the ink remains in the ink absorber, and it is very difficult to accurately detect changes in optical reflectance from the interface between an ink cartridge wall and an ink absorber.

SUMMARY OF THE INVENTION

An object of the present invention, which was devised in order to resolve the problems with the prior art noted above, is to provide an ink jet recorder of the type wherein an ink jet head and an ink cartridge are made to sweep across a recording medium by means of a carriage, wherein the remaining ink volume can be detected with high precision.

According to an aspect of the present invention, an ink jet recorder is provided which comprises: an ink jet head for ejecting ink onto a recording medium; an ink cartridge for supplying ink to the ink jet head, provided on the ink jet head so as to be detachable; a carriage that holds the ink jet head, capable of sweeping across the recording medium; a detector for detecting whether or not ink fluid level in the ink cartridge is at a prescribed level; a display for indicating ink cartridge replacement; and a controller for controlling the detector and the display so that the detector performs at least two detection operations and, when two of those at least two detection operations indicate an ink fluid level lower than the prescribed level, the display displays ink cartridge replacement thereon.

The recorder according to the present invention performs at least two remaining ink volume detection operations and determines that insufficient ink remains in the ink cartridge when the results of at least two of those detection operations indicate an ink fluid level lower than a prescribed level. Therefore, erroneous ink level determinations can be minimized even though ink waves develop inside the ink cartridge due to the movement of the carriage in the sweep direction.

In the recorder according to the present invention, the ink cartridge mentioned above may be formed of a light-transmitting material. The detector mentioned above may be an optical sensor that directs light onto the inner side surface of the ink cartridge and detects the light reflected back therefrom. Depending on whether there is or is not ink on the surface of the inner wall of the ink chamber inside the ink cartridge, that is, on whether an ink layer or an air layer is present there, the refractive index or, alternatively, the reflectance changes at the interface between the inner wall surface and the ink layer or air layer. The optical sensor detects variations in the amount of light received as reflected light from the surface of the inner wall of the ink chamber. The detector may be a sensor that measures electrical resistance between electrodes.

The controller is capable of performing two detection operations with the detector and, if both of these detection operations indicate an ink fluid level short of the prescribed level, indicating ink cartridge replacement on the display. Thus processing can be done simply and in a short time. If only one of the two detection operations indicates an ink fluid level short of the prescribed level, then a third detection operation may be performed by the detector, and ink cartridge replacement indicated on the display if two out of the three detection operations indicate an ink level short of the prescribed level.

Alternatively, the controller may perform three detection operations and indicate ink cartridge replacement on the display if two out of those three detection operations indicate an ink fluid level short of the prescribed level.

The ink jet recorder according to the present invention may comprise a purge unit that has a suction cap which covers the ink jet head and sucks ink from the head. When that is the case, if the optical sensor is attached to the purge unit, the controller may perform detection operations by the detector described above while the purge unit is performing a purge operation. In other words, in that case, the ink jet recorder is able to perform purge operations and remaining ink volume detection operations simultaneously any time the ink jet head is not recording on the recording medium.

The ink jet recorder according to the present invention may also comprise a timer, whereupon each of the at least two detection operations by the detector can be performed after a prescribed time has elapsed since the last detection operation, as measured by the timer. The prescribed time may be made a time interval that does not coincide with the wave-generation period for the ink inside the ink cartridge. For example, if it takes 0.2 seconds for the carriage holding the ink carriage to move (sweep) across an A4 size paper sheet in its widthwise direction, the wave generation period is about 5 Hz. Considering a reflection of the wave from a inner wall of the cartridge, the wave generation period might be slightly higher than 5 Hz. Thus, by adjusting the time interval between the two detection operations, in cases where the first detection operation indicates an erroneous result due to the influence of ink waves inside the ink cartridge, results differing from the first results can be indicated by the next detection operation, so that true detection results can be produced that take into consideration those later detection results. By adjusting the prescribed time interval in this manner, furthermore, it is not necessary to provide a waiting time to allow the waves inside the ink cartridge to subside, wherefore remaining ink volume detection can be done quickly.

The ink cartridge described in the foregoing may be made so as to have a first ink chamber for supplying ink to the ink jet head and a second ink chamber allowing liquid to communicate therebetween, the first ink chamber being smaller in capacity than the second ink chamber. In that case, the detector described earlier can detect whether or not the ink fluid level in the first ink chamber is at a prescribed level. Thus the formation of ink waves can be suppressed by making the volume of the first ink chamber small.

DESCRIPTION OF THE PREFERRED EMBODIMENTS

Figure 1:
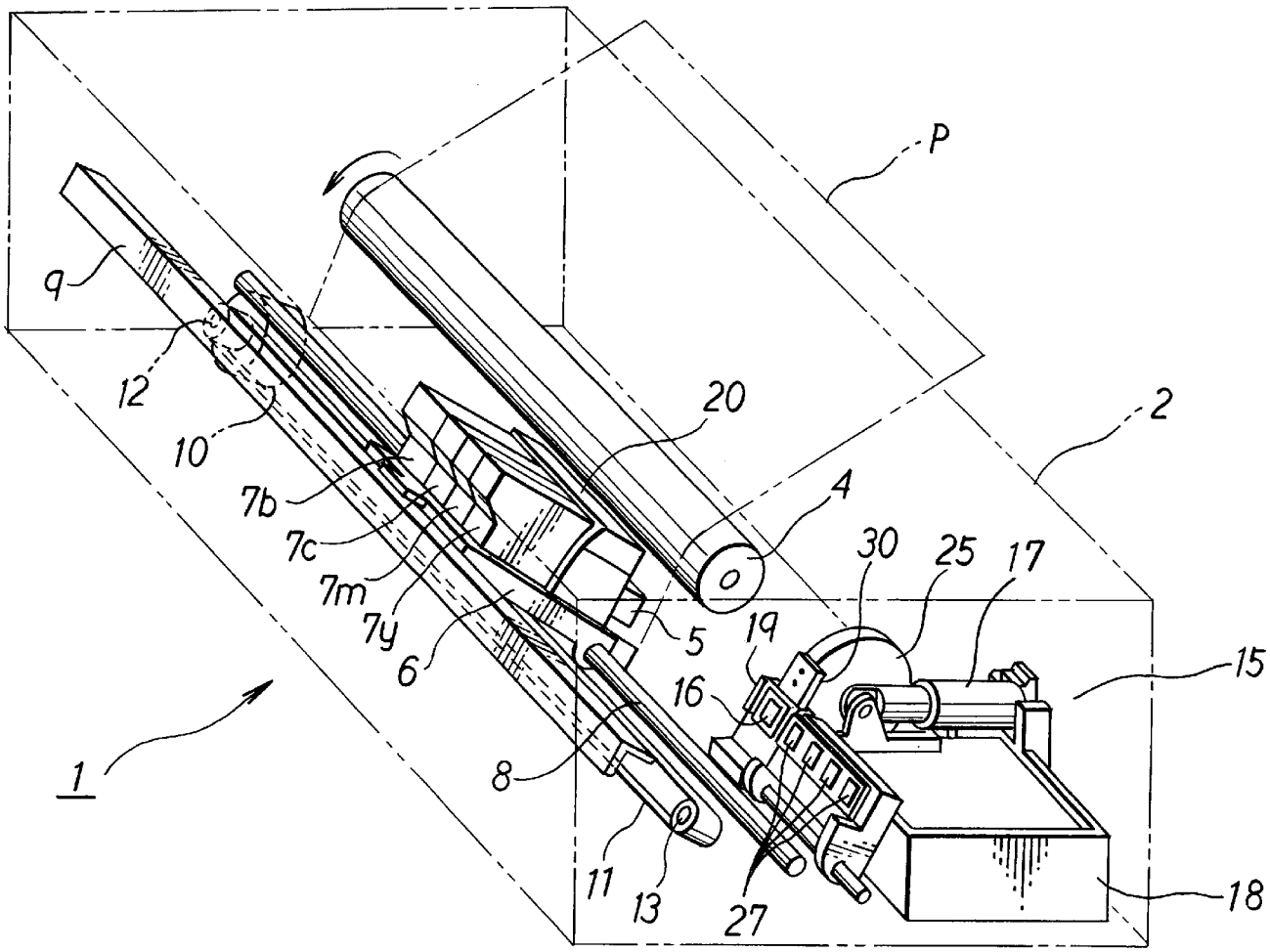
FIG. 1 is a conceptional perspective view of an ink jet recorder according to the present invention, provided with a remaining ink volume detector.

A specific example of an ink jet recorder according to the present invention is now described with reference to the drawings. As shown in FIG. 1, a recorder 1 that is an ink jet type of printer comprises a feeder roller 4 of cylindrical shape supported so that it can turn in a frame 2. In front of the feeder roller 4 is provided a carriage 6, whereon is mounted an ink jet recording head 5, such that it can move horizontally along the axis line of the feeder roller 4. The feeder roller 4 turns in the direction indicated by the arrow in FIG. 1 and thereby feeds a recording medium P supplied from a paper supply cassette or manually loaded paper hopper toward the recording head 5. The recording head 5 comprises four recording head units for dispensing four ink colors, namely yellow, magenta, cyan, and black, for performing color recording. The recording medium P is supplied from a paper supply slot (not shown) at the back of the frame 2, made to pass over the recording head 5, and discharged from a paper discharge slot (not shown).

On the carriage 6 are mounted, so that they are removable, respectively, a head module 20 comprising the recording head 5, and ink cartridges 7*y*, 7*m*, 7*c*, and 7*b* for supplying ink to the recording head 5. The carriage 6 is held, by support at the front thereof by a carriage shaft 8 positioned parallel to the axis line of the feeder roller 4 and by support at the back by a support member 9, so that the recording head 5 at the front thereof is inclined downward. A carriage drive motor 10 (hereinafter called the CR motor) for driving the carriage 6 drives the carriage 6 by means of a belt 11 and pulleys 12 and 13. A stepper motor or DC motor may be used for the CR motor 10. Given this configuration, the recording head 5 mounted on the carriage 6 performs recording while sliding laterally over the recording medium P that is supported by the feeder roller 4.

A maintenance mechanism 15 for recovering from recording head 5 dispensing failures or dispensing problems is positioned outside of the recording range for the recording medium P, on the right side, in FIG. 1, with respect to the feeder roller 4. The ink jet type recording head 5 is subject, during operation, to dispensing problems caused by air bubbles developing inside and by ink droplets adhering to the dispensing surface. The maintenance mechanism 15 recovers from such dispensing problems and prevents recording head nozzles from drying up. The maintenance mechanism 15 is provided with a suction cap 16. The suction cap 16 covers the nozzles of the recording head 5, and restores the recording head 5 by purging or sucking out ink from the interior of the recording head 5 by employing a negative pressure produced by a pump 17. The ink that is sucked out is sent to a storage tank 18.

A wiper 19 is provided on the recording area side of the suction gap 16 for wiping the dispensing surface of the recording head 5. This wiping operation by the wiper 19 and the problem ink suction operation by the suction 16 described above are performed individually for each of four nozzles on the recording head 5. The suction cap 16, pump 17, and wiper 19 are driven by a cam drive motor 59 (cf. FIG. 3), the driving force whereof is transmitted via a pump cam gear 25 when the carriage 6 enters the restoration area (maintenance area). A protective cap 27 is also provided, on the right side of the suction cap 16, for covering the recording head 5 when recording operations have been suspended. The purpose of this protective cap 27, which has as many capping units as the number of head units, is to prevent ink from drying inside the nozzles of the recording head 5. Above the suction cap 16 is provided a remaining ink volume detection sensor 30 that comprises optical sensors, positioned in opposition to the ink cartridges 7*y*, 7*m*, 7*c*, and 7*b* on the carriage 6, for detecting remaining ink volumes in the ink cartridges 7*y*, 7*m*, 7*c*, and 7*b*. This remaining ink volume detection sensor 30 will be described in detail later.

Figure 2:
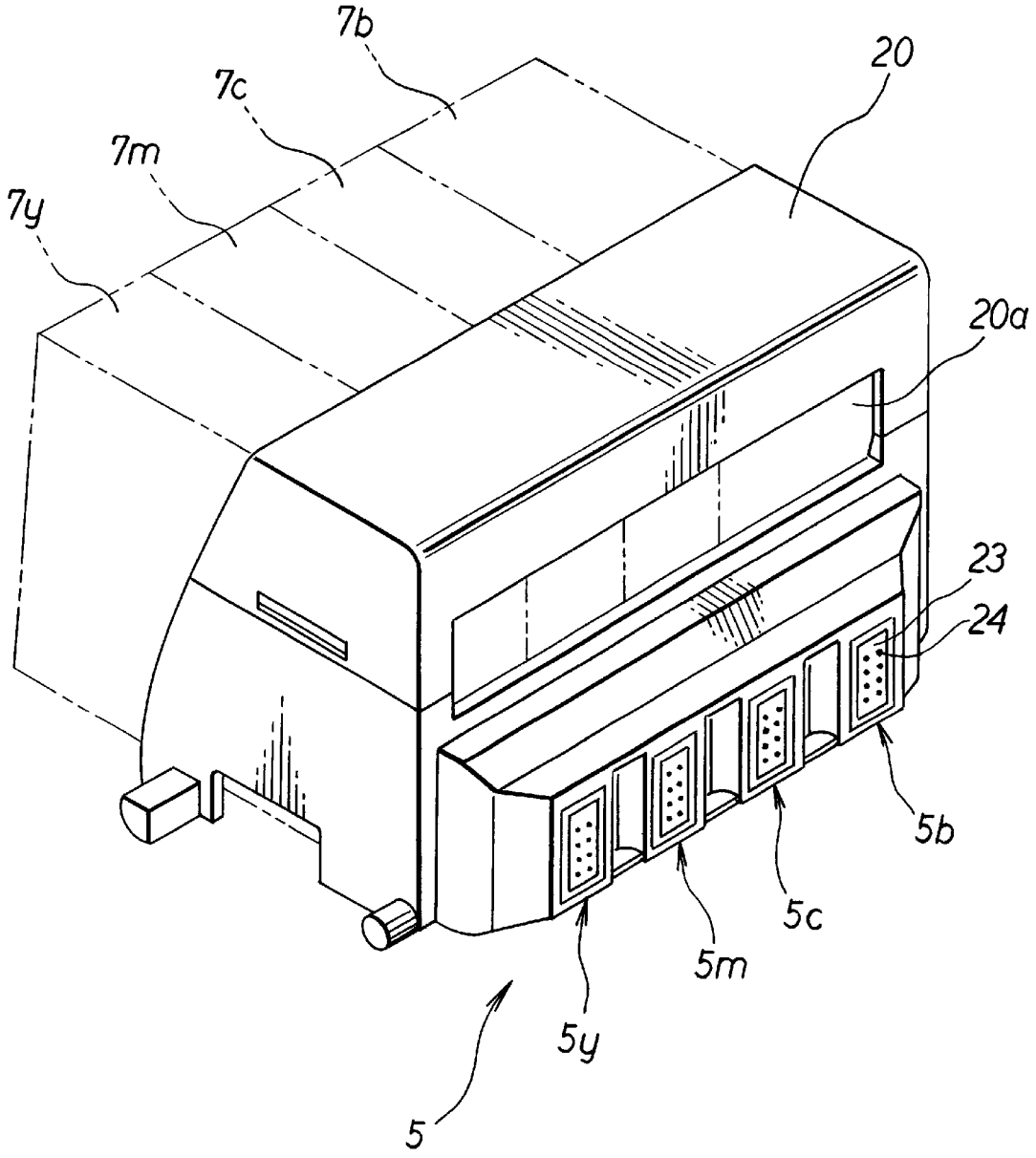
FIG. 2 is a perspective view of a head unit comprised in the recorder shown in FIG. 1.

The head unit 20 mounted on the carriage 6 is now described with reference to FIG. 2. FIG. 2 is a partial perspective view of the head module 20. As described in the foregoing, the recording head 5 is contained in the head module 20. This recording head 5 comprises four recording head units 5*y*, 5*m*, 5*c*, and 5*b* for dispensing four colors, namely yellow, magenta, cyan, and black, for color recording. Each of the recording head units 5*y*, 5*m*, 5*c*, and 5*b* has multiple nozzles 24 formed in a nozzle plate 23. From these nozzles 24, ink of each color is ejected onto the recording medium P. The ink cartridges 7*y*, 7*m*, 7*c*, and 7*b* consist of transparent or semitransparent cases so that the remaining ink volume can be visually verified from the outside. The ink cartridges are loaded from the opposite side of the surface whereon the recording head 5 is provided, relative to the head module 20, connected respectively to corresponding recording head units 5*y*, 5*m*, 5*c*, and 5*b*. An opening 20*a* is provided in the head module 20, above where the recording head 5 is provided. This opening 20*a* makes it possible for the remaining ink volume detection sensor 30 described above to direct light beams directly onto the ink cartridges 7*y,* 7*m,* 7*c,* and 7*b.*

Figure 3:
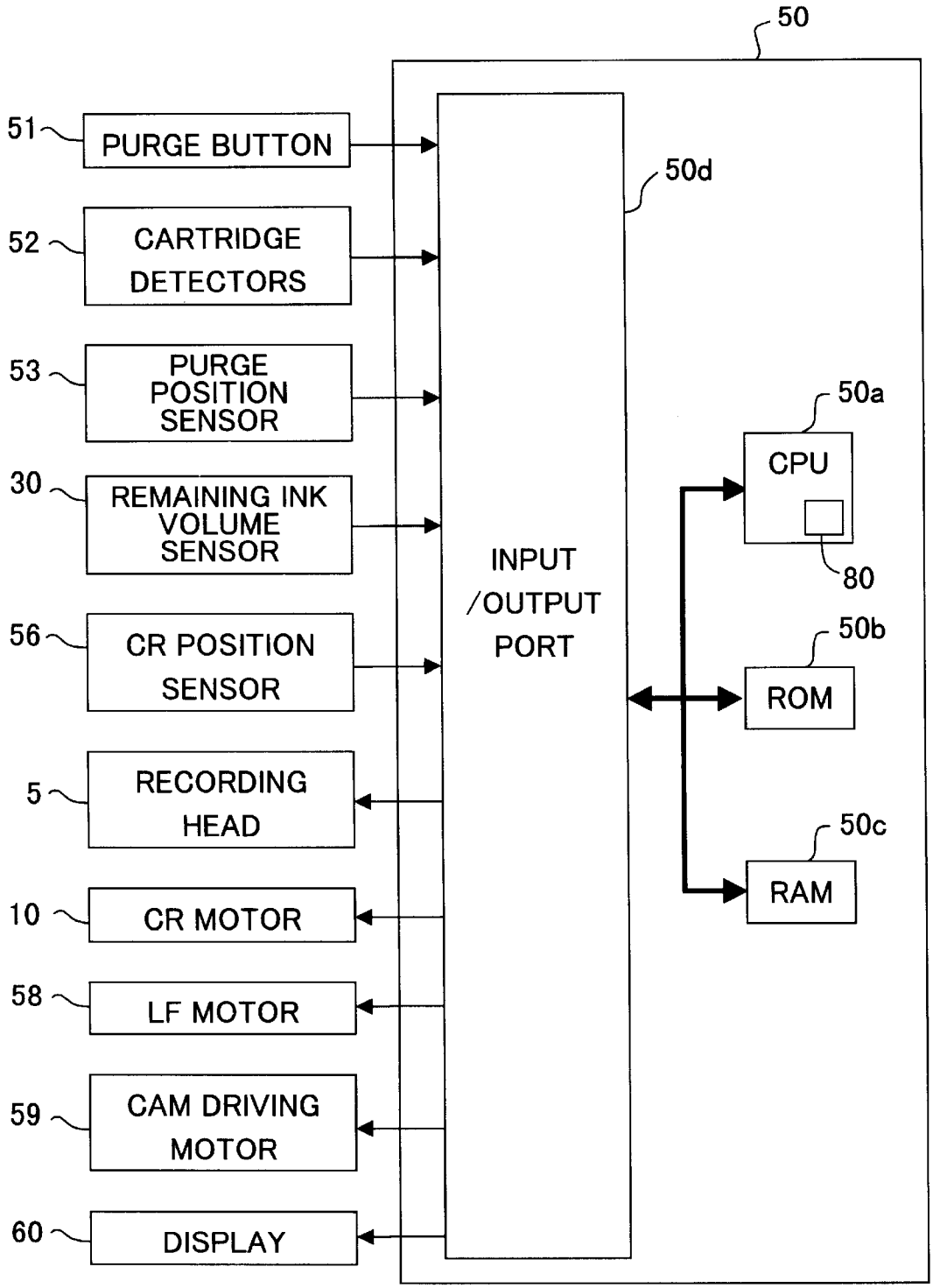
FIG. 3 is a block diagram representing the electrical configuration of the recorder shown in FIG. 1.

The electrical configuration of the recorder 1 is described next, with reference to FIG. 3. FIG. 3 is a block diagram of the electrical configuration of the recorder 1. The recorder 1 comprises a controller 50 for controlling the components of the recorder 1. The controller 50 contains a CPU 50*a* for providing overall operational control for the recorder 1. This CPU 50*a* is connected to a ROM 50*b* wherein operating programs, etc., are stored, and to a RAM 50*c* for temporarily storing recording data received by the CPU 50*a* from a host computer (not shown). The CPU 50*a* has a built in timer 80 for measuring the elapsed time from the point in time when the carriage 6 stopped at the detection position for detecting remaining ink volumes by the remaining ink volume detection sensor 30.

The CPU 50*a* is connected via an I/O unit 50*d* to a purge button 51 and other apparatus components. The purge button 51, when depressed by an operator, outputs to the CPU 50*a* a signal to start a purge operation by the suction cap 16 and pump 17. A cartridge detector 52 detects whether or not an ink cartridge 7 has been loaded in the carriage 6 and outputs the detection result to the CPU 50*a*. A purge position sensor 53 detects whether or not the recording head 5 is at a position opposite the suction cap 16 when a purge operation is being done and outputs the result of that detection result to the CPU 50*a*. A CR position sensor 56 detects the positions of the carriage 6 as it performs sweeping movements and outputs the results to the CPU 50*a*. The remaining ink volume detection sensor 30 described earlier is also connected to the CPU 50*a*. Based on outputs from the remaining ink volume detection sensor 30, the CPU 50*a* determines whether or not ink volumes remain in the ink cartridge 7.

To the CPU 50*a* are also connected the recording head 5, the CR motor 10, and an LF motor 58. The CPU 50*a* controls recording operations by the recording head 5, and also controls the drives from the CR motor 10 and the LF motor (feeder roller drive motor) in coordination with the recording operations of the recording head 5. The cam drive motor 59 and display unit 60 are also connected to the CPU 50*a*. The cam drive motor 59 is controlled so as to be activated when the CR position sensor 56 has detected that the carriage 6 has moved to the restoration (maintenance) position. The display unit 60 is controlled so as to provide displays in response to the remaining ink volume detection results obtained by the remaining ink volume detection sensor 30 and to other operating states of the components of the recorder 1.

Figure 4:
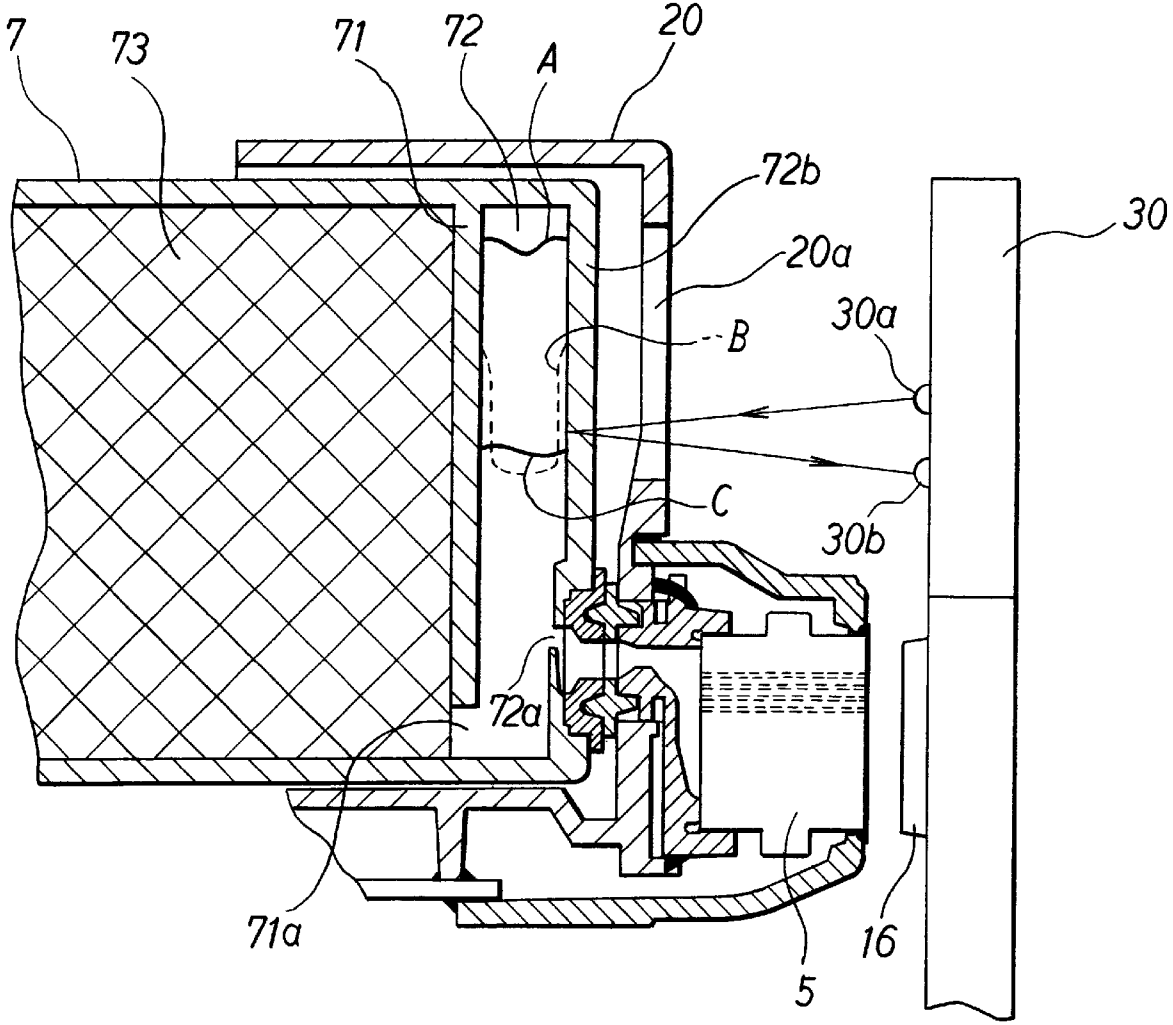
FIG. 4 is a cross-sectional view of a head unit and remaining ink volume detecting sensor comprised in the recorder shown in FIG. 1.

The detection of remaining ink volumes by the remaining ink volume detection sensor 30 in the ink cartridges 7*y,* 7*m,* 7*c,* and 7*b* (hereinafter referred to generally as the ink cartridge 7) is next described with reference to FIG. 4. FIG. 4 provides a partial cross-sectional view of the head module 20 and the remaining ink volume detection sensor 30. The remaining ink volume detection sensor 30 comprises a light emitter 30*a* for illuminating light beams onto the ink cartridge 7, and a photodetector 30*b* for receiving light from the light beams that is reflected back from the inner wall surfaces of the case of the ink cartridge 7. The ink cartridge 7 is partitioned into a first ink chamber 72 and a second ink chamber 73 by a partition wall 71 inside the case, such that these two ink chambers can communicate with each other by a connecting hole 71*a* formed at the bottom of the partition wall 71. The first ink chamber 72 is smaller in capacity than the second ink chamber 73, the top thereof is tightly sealed, and an ink supply port 72*a* is provided toward the bottom of one side surface thereof for supplying ink to the recording head 5. A porous ink impregnation material (foamed material) is placed in the second ink chamber 73, at the back thereof is provided an opening (not shown) for admitting air.

Ink is loaded into the first ink chamber 72 and second ink chamber 73 in the ink cartridge 7. When ink in the first ink chamber 72 is supplied to the print head from the ink supply port 72*a,* ink flows from the second ink chamber 73 through the connecting hole 71*a* to the first ink chamber 72 so that the volume of ink used from the first ink chamber 72 is replenished. Thus, even though the amount of ink in the ink cartridge 7 is depleted by the supply of ink to the recording head 5, this is depleted from the second ink chamber 73, wherefore the first ink chamber 72 is maintained in a nearly filled state. Ink is only depleted in the first ink chamber 72 after the ink in the second ink chamber 73 is almost completely depleted so that air enters from that chamber into the first ink chamber 72, whereupon the ink fluid level A in the first ink chamber 72 drops. Accordingly, when the ink fluid level in the first ink chamber 72 falls, there will be little total ink volume remaining in the ink cartridge 7. Accordingly, the presence of an amount of ink remaining in the ink cartridge 7 can be known because the remaining ink volume detection sensor 30 detects the position of the ink level in the first ink chamber 72.

When a light beam is directed from the light emitter 30*a* of the remaining ink volume detection sensor 30 onto the inner surface of the side wall 72*b* of the first ink chamber 72 in the ink cartridge 7 on the side toward the recording head 5, the reflected light condition at the inner surface of the side wall 72*b* will change depending on whether or not ink is present on that inner wall surface. In other words, depending on whether ink is or is not present, the refractive index or reflectance at the interface between the inner surface of the side wall 72*b* and the ink or air inside will change. When ink is not present, the amount of light reflected at the inner wall surface will be greater than when ink is present. Thus the photodetector 30*b* will receive a greater amount of light when the ink disappears. Accordingly, based on the amount of light received by the photodetector 30*b,* it is possible to detect whether or not the ink fluid level in the first ink chamber 72 has fallen, that is, to detect whether or not the remaining ink volume in the ink cartridge 7 is almost gone.

When, for example, the ink in the first ink chamber 72 is depleted so that the fluid level falls to point C, the amount of light received by the photodetector 30*b* increases, and it can be determined that there is now very little remaining ink volume in the ink cartridge 7. However, it will sometimes happen that, immediately after the sweep motion of the carriage 6 has been stopped, waves will be formed in the ink inside the first ink chamber 72 due to vibration induced by the sweep movement, so that, although the true ink level is at position C, the condition of the ink surface will be as indicated by the broken line at B. When a detection operation is performed by the remaining ink volume detection sensor 30 in such a case, the detection result will erroneously indicate that there is a remaining ink volume. In view of this, the remaining ink volume detector performs multiple remaining ink volume detection operations by the remaining ink volume detection sensor 30 after the sweep movement of the carriage 6 has stopped. The processing performed during such remaining ink volume detection operations is now described.

Figure 5:
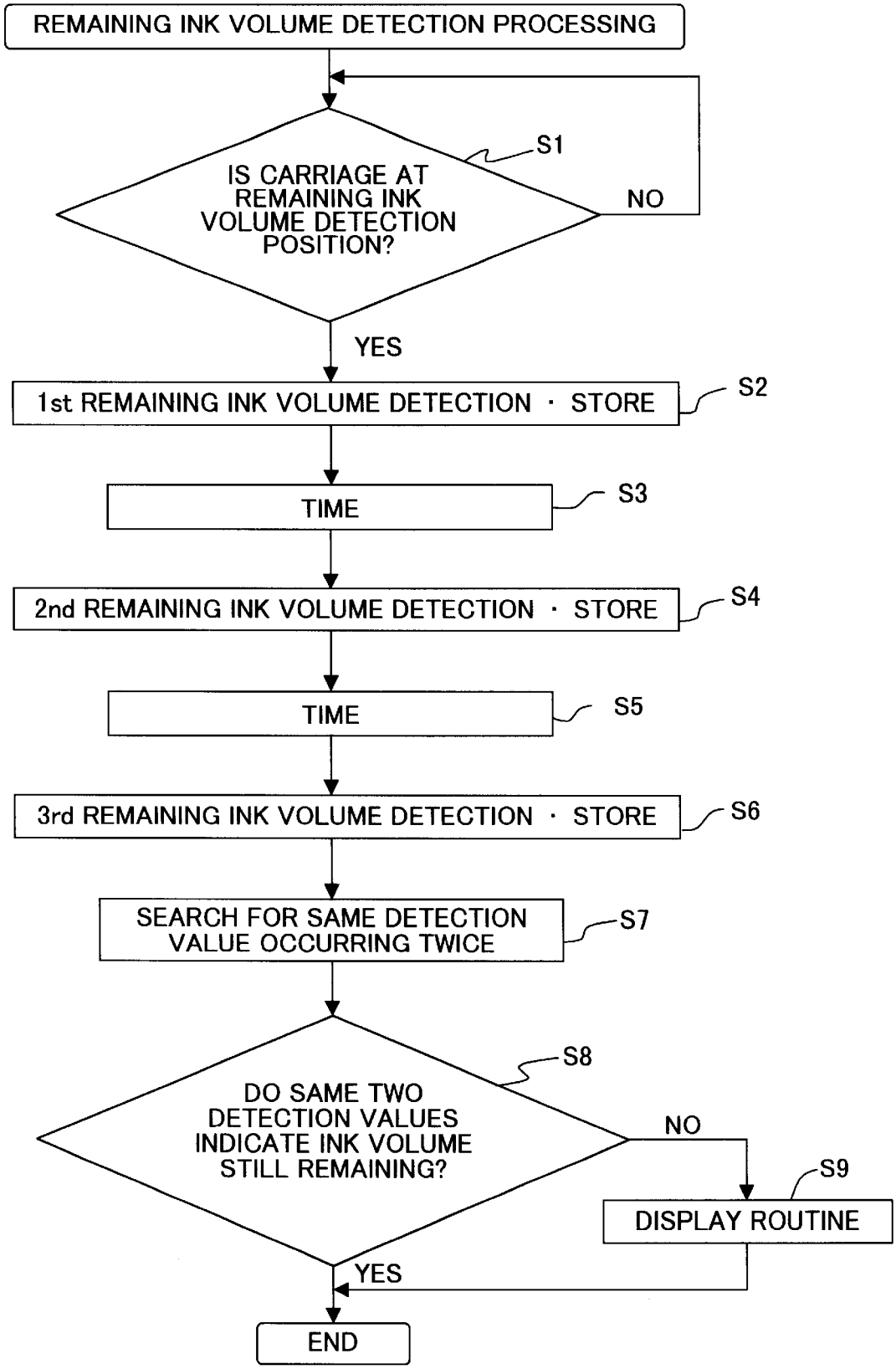
FIG. 5 is a flowchart of remaining ink volume detection processing with the remaining ink volume detector of the recorder shown in FIG. 1.

Remaining ink volume detection processing is now described with reference to FIG. 5. FIG. 5 is a flowchart showing the flow of remaining ink volume detection processing performed by the remaining ink volume detector. When the CR position sensor 56 detects that the carriage 6 has moved to the remaining ink volume detection position (that being, in this specific example, the same position as the restoration position for the suction cap 16 and maintenance mechanism 15) (YES in S1), the first remaining ink volume detection operation is performed by the remaining ink volume detection sensor 30, the presence or absence of remaining ink is judged accordingly, and the resulting detection value is stored in the RAM 50*c* (S2). After the first remaining ink volume detection operation by the remaining ink volume detection sensor 30, the timer built into the CPU 50*a* begins timing and, when a prescribed time period has elapsed (S3), a second remaining ink volume detection operation is performed, the presence or absence of remaining ink is judged based on that detection value, and the result is stored in the RAM 50*c* (S4). The prescribed time period is one that does not coincide with the wave generation period for the ink inside the ink cartridge 7 due to vibration caused by sweep movements of the carriage 6. For example, if it takes 0.2 seconds for the carriage 6 to move across an A4 size paper sheet in its widthwise direction, the wave generation period is about 5 Hz. Considering an effect of wave reflection from inner walls of the cartridge 6, the wave generation period might be slightly higher than 5 Hz. Subsequently, in like manner, after a prescribed time period has elapsed (S5), a third remaining ink volume detection operation is performed, and the result of the judgment on the presence or absence of remaining ink is stored in the RAM 50*c* (S6). Next, a determination is made as to whether or not any two of the three detection values stored in the RAM 50*c* indicate either that there is or that there is not a remaining ink volume (S7). When the two detection values indicating the same result indicate that there is no remaining ink volume (NO in S8), a routine is executed to display "no ink remaining" on the display unit 60 (cf. FIG. 3) (S9). When the two detection values indicating the same result indicate that there is a remaining ink volume (YES in S8), the display routine is not executed and processing is stopped. This operation is performed for every color so that the carriage 6 is moved so that each color ink cartridge 7 is sequentially brought opposite the detection position.

Thus, as based on the remaining ink volume detector in the ink jet recorder in this specific example, when performing remaining ink volume detection by the remaining ink volume detection sensor 30, three remaining ink volume detection operations are performed, after the sweep movement of the carriage 6 has stopped, and the two detection values thereof indicating the same result are taken to represent the detection result of the remaining ink volume detector. Therefore the presence or absence of remaining ink can be detected with greater precision than when only one remaining ink volume detection operation is performed and that detection value is taken as the detection result. The second and third remaining ink volume detection operations, moreover, are performed after a prescribed time has elapsed after the sweep movement of the carriage 6 has stopped, that is, at a time interval that does not coincide with the wave formation period for the ink inside the ink cartridge 7. Hence, even when detection operations are performed while a wave is formed in the ink surface, recognition errors resulting from detecting either only a high fluid level or only a low fluid level are eliminated, and the presence or absence of a remaining ink volume can be detected accurately. Because of this, a remaining volume detection operation can be started immediately, without waiting for ink waves to subside. In addition, since the first ink chamber 72 is made to have a small capacity, ink waves formed in the first ink chamber 72 will subside quickly after the sweep movement of the carriage 6 has stopped. For this reason, the wait time from the stopping of the sweep movement of the carriage 6 until remaining ink volume detection can be performed is shortened. When the purge position sensor 56 has detected the carriage, moreover, the motor 59 can be activated so that the suction cap 16 is brought up against the recording head 5 and a purge operation started while remaining ink volume detection is being performed.

Figure 6A:
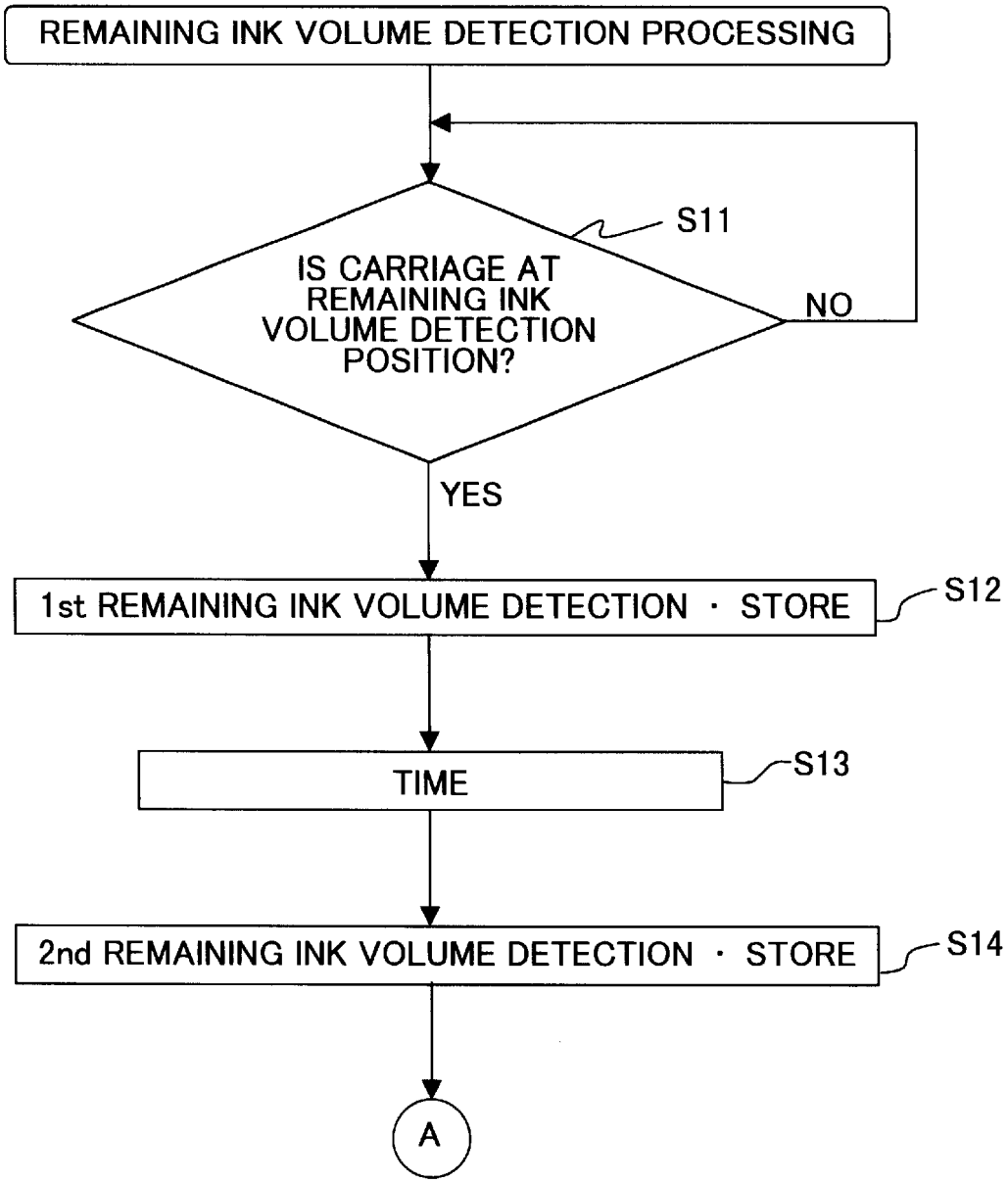
FIGS. 6A and 6B are flowcharts of remaining ink volume detection processing according to another specific example of the present invention.
Figure 6B:
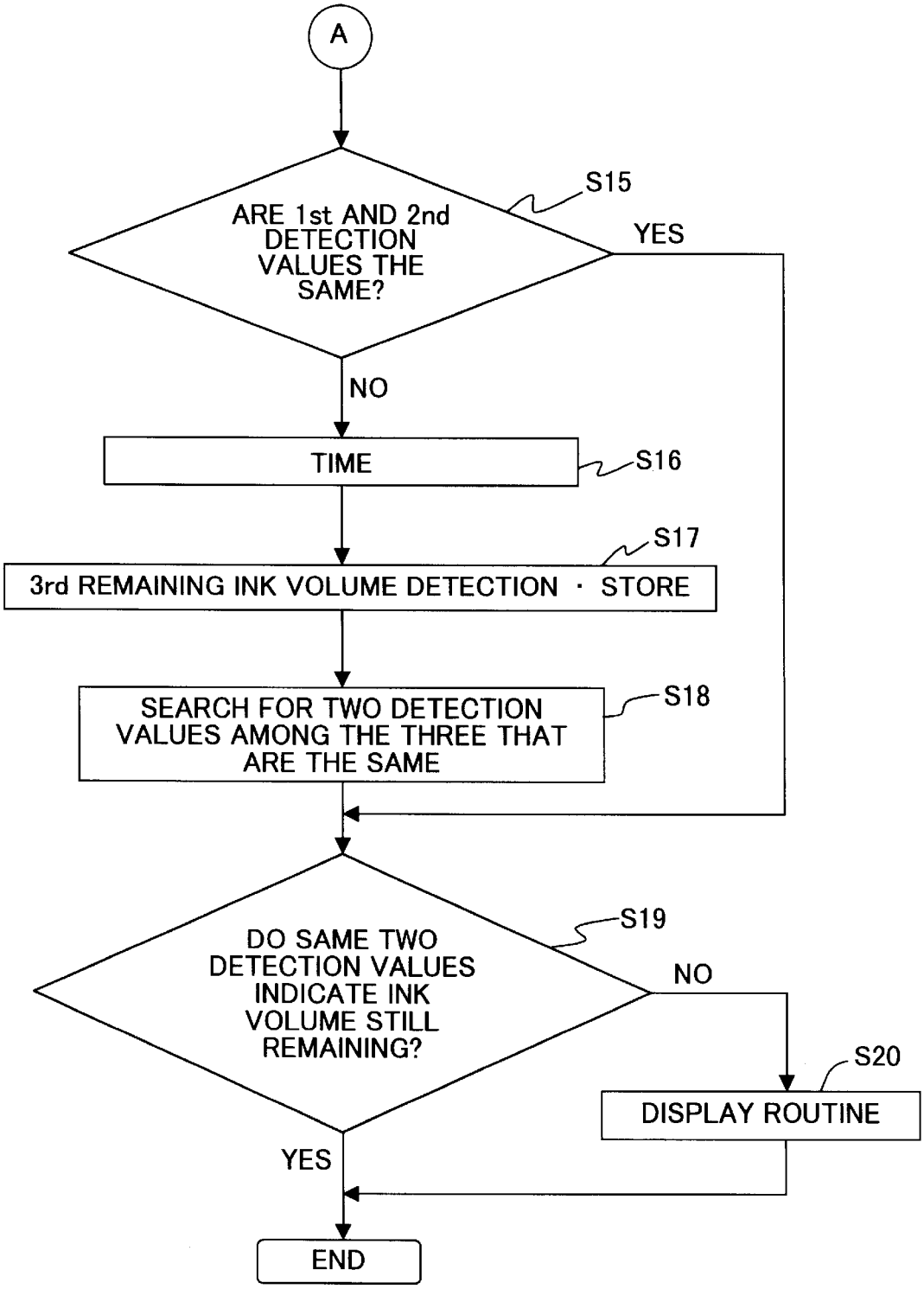

Another specific example of the remaining ink volume detection described in the foregoing is now described with ref to FIG. 6. FIG. 6 is a flowchart showing the flow in remaining ink volume detection processing relating to this other specific example. When it has been detected that the carriage 6 has moved into place at the remaining ink volume detection position described earlier (YES in S11), the first remaining ink volume detection operation is performed by the remaining ink volume detection sensor 30, the presence or absence of remaining ink is judged accordingly, and the resulting detection value is stored in the RAM 50*c* (S12). After the first remaining ink volume detection operation by the remaining ink volume detection sensor 30, the timer built into the CPU 50*a* begins timing and, when a prescribed time period has elapsed (S13), a second remaining ink volume detection operation is performed, the presence or absence of remaining ink is judged based on that detection value, and the result is stored in the RAM 50*c* (S14).

At this point a determination is made as to whether the results indicated by the first and second detection values indicate the same result concerning the presence or absence of remaining ink volume (S15). When the results indicated by both the first and second detection value indicate the same result concerning the absence or presence of remaining ink volume (YES in S15), a determination is made as to whether the result indicated by the first and second detection value indicates that a remaining ink volume is or is not present (S19). When these two detection values indicate that there is no remaining ink volume (NO in S19), a routine is executed to display "no ink remaining" on the display unit 60 (S20). When the two detection values indicate that there is a remaining ink volume (YES in S19), processing is ended without executing the display routine.

When in the S15 routine it is determined that the results indicated by the first and second detection value indicate different results concerning the presence or absence of remaining ink volume (NO in S15), a prescribed time is allowed to elapse (S16), and then a third remaining ink volume detection operation is performed and the result of the judgment on the presence or absence of remaining ink volume is stored in the RAM 50*c* (S17). A determination is then made as to whether the two detection values that, of the three detection values recorded in the RAM 50*c*, agree indicate that there is or is not a remaining ink volume (S18). When the two agreeing values indicate that there is no remaining ink volume (NO in S19), the routine is executed to display "no ink remaining" on the display unit 60. When the two agreeing values indicate that there is a remaining ink volume (YES in S19), processing is terminated without executing the display routine. By executing these processing routines, the detection of whether or not a there is remaining ink volume can be done quickly.

The present invention is not limited to or by the specific examples cited above, but can be modified in various ways. The time interval for performing the multiple remaining ink volume detection operations can be made random, for example, instead of constant. In the embodiments described in the foregoing, moreover, the remaining ink volume may be checked utilizing the fact that the amount of light reflected back from the light beam emitted from the light emitter 30*a* will vary depending on the color of the ink in the ink cartridge 7.

In the embodiments described in the foregoing, furthermore, the recorder 1 wherein the remaining ink volume detector of the present invention is employed is made an ink jet type of printer, but this poses no limitation, and applications are possible in fax machines and copy machines so long as they are recording devices which use liquid ink stored in an ink cartridge. In the specific examples cited above, moreover, the remaining ink volume detection sensor 30 is attached above a suction cap 16 that performs purges, and remaining ink volume detection operations are conducted in a maintenance position outside of the recording area. However, it is possible to locate the remaining ink volume detection sensor 30 at some other position, such as above the protective cap 27 or on the carriage 6, so long as the recording action of the recording head 5 is not interfered with. By attaching the sensor 30 on Ad the carriage 6, detection operations can be performed while the carriage is moving. In that case too the effects of wave formation, as described earlier, can be avoided.

What is claimed is:

1. An ink jet recorder, comprising:

an ink jet head for ejecting ink onto a recording medium;

an ink cartridge for supplying ink to the ink jet head, provided on the ink jet so as to be detachable;

a carriage that holds the ink jet head, capable of sweeping across the recording medium;

a detector for detecting whether or not ink fluid level in the ink cartridge is at a prescribed level;

a display for indicating ink cartridge replacement; and a controller for controlling the detector to perform a predetermined number of detection operations to determine a final detection result, considering a majority of detection results of the detection operations as the final detection result, and controlling the display to display an ink cartridge replacement message thereon when the final detection result indicates an ink fluid level lower than the prescribed level, wherein the predetermined number is at least two, and the means for controlling terminates the detection operations once the majority is obtained regardless of completion of the predetermined number of detection operations.

2. The ink jet recorder according to claim 1, wherein the ink cartridge is formed of a light-transmitting material, and the detector is an optical sensor that directs light onto inner side surface of the ink cartridge and detects light reflected therefrom.

3. The ink jet recorder according to claim 1, wherein the controller controls the detector and the display so that the detector performs two detection operations and, if both detection operations indicate an ink fluid level short of the prescribed level, the display displays ink cartridge replacement thereon.

4. The ink jet recorder according to claim 3, wherein, the controller controls the detector and the display so that, if one of the two detection operations indicates an ink fluid level short of the prescribed level, the detector performs a third detection operation and, if any two of these three detection operations indicates an ink fluid level short of the prescribed level, the display displays ink cartridge replacement thereon.

5. The ink jet recorder according to claim 1, wherein the controller controls the detector and the display so that the detector performs three detection operations, and, if any two of the three detection operations indicates an ink fluid level short of the prescribed level, the display displays ink cartridge replacement thereon.

6. The ink jet recorder according to claim 2, further comprising a purge unit having a suction cap for covering the ink jet head and sucking ink from the head, wherein the optical sensor is attached to the purge unit.

7. The ink jet recorder according to claim 1, further comprising a timer, wherein at least two detection operations by the detector are performed, respectively, after a prescribed time measured by the timer since previous detection operation has elapsed.

8. The ink jet recorder according to claim 7, wherein the prescribed time is a time interval different from period wherewith ink waves are generated inside the ink cartridge due to sweeping of carriage across the recording medium.

9. The ink jet recorder according to claim 1, wherein the ink cartridge contains therein a first ink chamber for supplying ink to the ink jet head and a second ink chamber that communicates fluid with the first ink chamber, the first ink chamber having a capacity smaller than the second ink chamber.

10. The ink jet recorder according to claim 9, wherein the detector detects whether ink fluid level in the first ink chamber is at the prescribed level.

11. The ink jet recorder according to claim 9 wherein the second ink chamber accommodates ink impregnation material.

12. The ink jet recorder according to claim 1, further comprising a memory device for storing results of detection operations by the detector.

13. The ink jet recorder according to claim 1, wherein the ink cartridge has a plurality of cartridge cases each of which includes a different ink.

14. The ink jet recorder according to claim 13, wherein the detection operations are performed for each cartridge case.

15. An inkjet recorder, comprising:

means for ejecting ink onto a recording medium;

means for supplying ink to the means for ejecting ink, provided on the ink jet so as to be detachable;

means for sweeping the means for ejecting ink across the recording medium;

means for detecting whether an ink fluid level in the means for supplying ink is at a prescribed level;

means for indicating ink replacement; and means for controlling the means for detecting to perform a predetermined number of detection operations to determine a final detection result, considering a majority of detection results of the detection operation as a final detection result, and controlling the means for indicating ink replacement to display an ink cartridge replacement message thereon when the final detection result indicates an ink fluid level lower than the prescribed level, wherein the predetermined number is at least two, and the means for controlling terminates the detection operations once the majority is obtained regardless of completion of the predetermined number of detection operations.

16. The ink jet recorder according to claim 15, wherein the means for supplying ink is formed of a light-transmitting material, and the means for detecting is an optical sensor that directs light onto inner side surface of the means for supplying ink and detects light reflected therefrom.

17. The ink jet recorder according to claim 15, wherein the means for controlling controls the means for detecting and the means for indicating ink replacement so that the means for detecting performs two detection operations and, if both detection operations indicate an ink fluid level short of the prescribed level, the means for indicating ink replacement displays ink replacement thereon.

18. The ink jet recorder according to claim 17, wherein the means for controlling controls the means for detecting and the means for indicating ink replacement so that, if one of the two detection operations indicates an ink fluid level short of the prescribed level, the means for detecting performs a third detection operation and, if any two of these three detection operations indicates an ink fluid level short of the prescribed level, the means for indicating ink replacement displays ink replacement thereon.

19. The ink jet recorder according to claim 15, wherein the means for controlling controls the means for detecting and the means for indicating ink replacement so that the means for detecting performs three detection operations, and, if any two of the three detection operations indicates an ink fluid level short of the prescribed level, the means for indicating ink replacement displays ink replacement thereon.

20. The ink jet recorder according to claim 16, further comprising a means for purging having a suction cap for covering the means for ejecting ink and sucking ink from the means for ejecting ink, wherein the optical sensor is attached to the means for purging.

21. The ink jet recorder according to claim 15, further comprising a timer, wherein at least two detection operations by the means for detecting are performed, respectively, after a prescribed time measured by the timer since previous detection operation has elapsed.

22. The ink jet recorder according to claim 21, wherein the prescribed time is a time interval different from period wherewith ink waves are generated inside the means for supplying ink due to sweeping of the means for sweeping across the recording medium.

23. The ink jet recorder according to claim 15, wherein the means for supplying ink contains therein a first ink chamber for supplying ink to the means for ejecting ink and a second ink chamber that communicates fluid with the first ink chamber, the first ink chamber having a capacity smaller than the second ink chamber.

24. The ink jet recorder according to claim 23, wherein the means for detecting detects whether ink fluid level in the first ink chamber is at the prescribed level.

25. The ink jet recorder according to claim 23, wherein the second ink chamber accommodates ink impregnation material.

26. The ink jet recorder according to claim 15, further comprising means for storing results of detection operations by the means for detecting.

27. The ink jet recorder according to claim 15, wherein the means for supplying ink has a plurality of cartridge cases each of which includes a different ink.

28. The ink jet recorder according to claim 27, wherein the detection operations are performed for each cartridge case.

* * * * *